US011643869B2

(12) United States Patent
Menendez

(10) Patent No.: US 11,643,869 B2
(45) Date of Patent: May 9, 2023

(54) HEM BAR FOR USE WITH AN ARCHITECTURAL-STRUCTURE COVERING

(71) Applicant: Hunter Douglas, Inc., Pearl River, NY (US)

(72) Inventor: Victor Menendez, McKinney, TX (US)

(73) Assignee: Hunter Douglas, Inc., Pearl River, NY (US)

( * ) Notice: Subject to any disclaimer, the term of this patent is extended or adjusted under 35 U.S.C. 154(b) by 150 days.

(21) Appl. No.: 16/380,006

(22) Filed: Apr. 10, 2019

(65) Prior Publication Data

US 2019/0323286 A1 Oct. 24, 2019

Related U.S. Application Data

(60) Provisional application No. 62/660,459, filed on Apr. 20, 2018.

(51) Int. Cl.
*E06B 9/17* (2006.01)

(52) U.S. Cl.
CPC ..... *E06B 9/17046* (2013.01); *E06B 9/17076* (2013.01)

(58) Field of Classification Search
CPC .... E06B 9/17046; E06B 9/17076; E06B 9/40; E06B 9/42; E06B 2009/546; E06B 9/54; E06B 9/582; E06B 9/44
(Continued)

(56) References Cited

U.S. PATENT DOCUMENTS 1,677,067 A * 7/1928 Zimmerman ..... E06B 7/18 49/480.1
2,922,202 A * 1/1960 Kodaras ..... E06B 7/20 49/306

(Continued)

FOREIGN PATENT DOCUMENTS

CN 204186264 U 3/2015
DE 202010009552 U1 * 10/2010 ..... E05F 15/40

(Continued)

OTHER PUBLICATIONS

"*Victor Menendez* v. *Hunter Douglas, Inc.*; United States Patent and Trademark Office; and Drew Hirshfeld Compliant," filed Jun. 15, 2021, at United States District Court, Eastern District of Texas Sherman Division, 67 pages.

*Primary Examiner* — Daniel P Cahn
*Assistant Examiner* — Jeremy C Ramsey
(74) *Attorney, Agent, or Firm* — Leavitt Eldredge Law Firm

(57) ABSTRACT

A hem bar for use with an architectural-structure covering such as, for example, a rollable screen (e.g., an outdoor insect screen, a solar screen, a hurricane screen, a privacy and security screen, etc.). The hem bar includes a weather strip for contacting or resting on a contacting surface when the covering is in a fully extended position. The weather strip is vertically, movably positioned relative to the hem bar. Additionally, the weather strip may be downwardly biased relative to the hem bar. The hem bar may also include a plurality of weight-receiving chambers for receiving, for example, a weighted rod, a weighted bar, or the like to assist in maintaining the covering in a taut condition (e.g., assists with maintaining constant tension on the covering) in the extended position. The hem bar may have a symmetrical design to eliminate any tilting or rocking motion.

24 Claims, 10 Drawing Sheets

(58) Field of Classification Search
USPC ..... 49/475.1, 480.1
See application file for complete search history.

(56) References Cited

U.S. PATENT DOCUMENTS

| | | | | | |
|---|---|---|---|---|---|
| 3,453,780 | A * | 7/1969 | Thompson | E06B 7/18 | 49/482.1 |
| 3,703,788 | A | 11/1972 | Rivers | | |
| 4,233,780 | A * | 11/1980 | Royce | E06B 7/16 | 49/475.1 |
| 4,538,380 | A * | 9/1985 | Colliander | E06B 7/2314 | 49/475.1 |
| 4,694,877 | A | 9/1987 | Dunbar | | |
| 4,712,598 | A * | 12/1987 | Bonacci | E06B 9/262 | 160/327 |
| 5,445,209 | A * | 8/1995 | Lichy | E06B 9/13 | 160/273.1 |
| 5,642,588 | A | 7/1997 | Sowers | | |
| 5,675,935 | A | 10/1997 | Lin | | |
| 6,195,939 | B1 | 3/2001 | Sowers | | |
| 6,508,292 | B1 * | 1/2003 | Saperas | E06B 9/54 | 160/272 |
| 6,550,522 | B1 | 4/2003 | Lennon et al. | | |
| 6,622,431 | B1 | 9/2003 | Simons | | |
| 7,260,915 | B2 | 8/2007 | Cronenberg et al. | | |
| 9,382,752 | B1 | 7/2016 | Bay | | |
| 2005/0224191 | A1 | 10/2005 | Nien | | |
| 2008/0035281 | A1 | 2/2008 | Kirby | | |
| 2017/0211315 | A1 * | 7/2017 | Fleischman | E06B 9/174 | |
| 2019/0257148 | A1 * | 8/2019 | Healam | E06B 9/17046 | |

FOREIGN PATENT DOCUMENTS

| | | | | |
|---|---|---|---|---|
| GB | 2463154 A | * | 3/2010 | E06B 9/08 |
| KR | 20110101652 | * | 9/2011 | E06B 7/21 |
| WO | 2010057226 A1 | | 5/2010 | |

* cited by examiner

HEM BAR FOR USE WITH AN ARCHITECTURAL-STRUCTURE COVERING

CROSS-REFERENCE TO RELATED APPLICATIONS

This is a non-provisional of, and claims the benefit of the filing date of, U.S. provisional patent application No. 62/660,459, filed Apr. 20, 2018, titled "A Hem Bar for Use with an Architectural-Structure Covering", the entirety of which application is incorporated by reference herein.

FIELD OF THE DISCLOSURE

The present disclosure relates generally to architectural-structure coverings, and more particularly to an improved hem bar for use with an architectural-structure covering such as, for example, an outdoor covering or screen.

BACKGROUND OF THE DISCLOSURE

Architectural-structure coverings for architectural openings and/or structures (used interchangeably herein without the intent to limit), such as windows, doors, archways, and the like, have taken numerous forms for many years. One known architectural-structure covering includes a covering such as a rollable flexible fabric or screen (e.g., an outdoor mosquito or insect screen, a solar screen, a hurricane screen, a privacy and security screen, etc.), or the like coupled to a rotatable member or roller that is movable between an extended position and a retracted position. A drive mechanism enables a user to raise and lower the covering between the extended and retracted positions by, for example, winding the covering about the rotatable member.

The architectural-structure covering includes a weighted bottom rail also known as a hem bar coupled to a lower end of the covering to weight the lower end of the covering. In use, the hem bar also includes a weather strip for providing a sealing contact between the covering and the contacting surface (e.g., floor). To function properly, however, the hem bar, which travels between a pair of side tracks, must remain level when traveling between the retracted and extended positions. In addition, the hem bar must remain level when resting on the floor. Unfortunately, a large number of outdoor contacting surfaces (e.g., floors) are uneven. As a result, when a level hem bar contacts an uneven contacting surface, a gap is created between the level hem bar and the uneven contacting surface (e.g., a static hem bar cannot conform to a sloping floor). This results in an undesirable appearance and/or can allow insects, etc. to intrude through the gap.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

In accordance with one aspect of the present disclosure, disclosed herein is an improved hem bar for use with an architectural-structure covering such as, for example, a rollable flexible fabric or screen (e.g., an outdoor insect screen, a solar screen, a hurricane screen, a privacy and security screen, etc.). In use, the hem bar is operatively coupled to a lower end of the covering portion of the architectural-structure covering so that the hem bar is movably associated with the covering. The hem bar includes a weather strip (e.g., a brush, a gasket, or the like) for contacting or resting on a contacting surface (e.g., a floor, a ledge, a sill, or the like) when the covering is in an extended position. The weather strip may be movably positioned with respect to a body portion of the hem bar so that the position of the weather strip relative to the hem bar may be movably adjusted so that the weather strip is better able to contact and seal with the contacting surface such as, for example, an uneven or non-level contacting surface. Additionally, the weather strip may be downwardly biased relative to the hem bar to facilitate better sealing between the bottom edge of the weather strip and the contacting surface, and to assist with ensuring that the body of the hem bar never rests on the contacting surface.

In addition, and/or alternatively, the hem bar may be symmetrically designed. In use, by providing a symmetrically weighted hem bar incorporating a biased weather strip enables the hem bar to maintain constant tension on the covering. That is, the degree to which the contacting surface is level (or not level), affects how the hem bar rests in the extended position, which affects the appearance of the covering. For example, if one side of the hem bar contacts the contacting surface before the other side of the hem bar makes contact, the covering could appear uneven, wavy, or the like. That is, an uneven hem bar could cause at least a portion of the covering to lose tension created by the weight of the hem bar, which could result in an undesirable appearance of the covering. In addition, allowing the hem bar to rest unevenly on the contacting surface can adversely affect how the system operates. By providing a hem bar in accordance with the present disclosure, the hem bar is better able to adjust to uneven contacting surfaces without the covering losing the tension created by the weight of the hem bar. For example, in one embodiment, the weather strip may be biased to provide a better contact (e.g., seal) against the contacting surface (e.g., weather strip is better able to match the slope of the uneven contacting surface) while ensuring that the body of the hem bar never rests on the contracting surface thus ensuring that constant tension is maintained on the covering.

Figure 1:
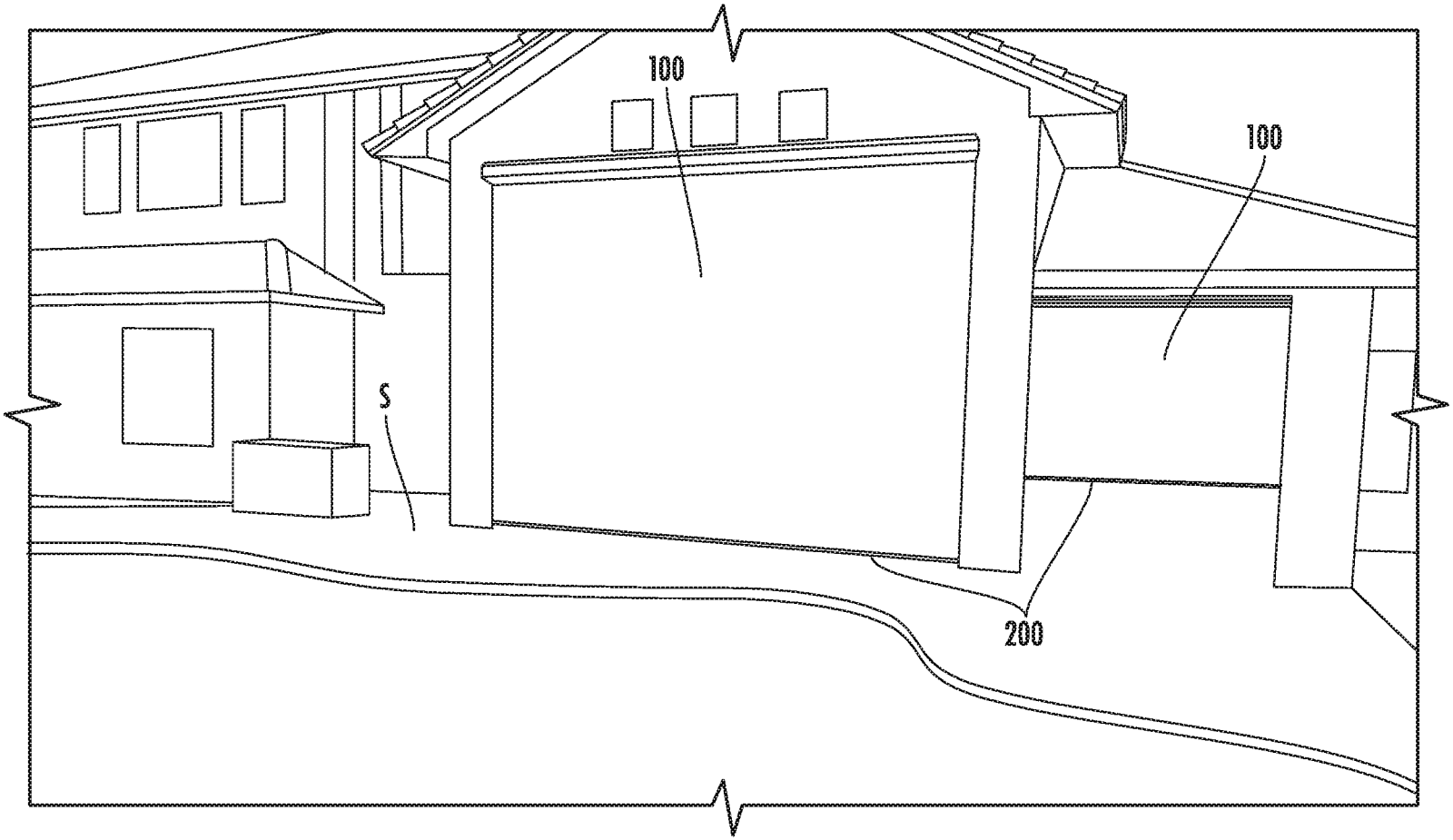
FIG. 1 is a perspective view illustrating an example of an embodiment of an architectural-structure covering including a covering shown in an extended position.

The drawings are not necessarily to scale. The drawings are merely representations, not intended to portray specific parameters of the disclosure. The drawings are intended to depict exemplary embodiments of the disclosure, and therefore are not be considered as limiting in scope. In the drawings, like numbering represents like elements.

DETAILED DESCRIPTION

Numerous embodiments of a hem bar in accordance with the present disclosure will now be described more fully hereinafter with reference to the accompanying drawings, in which embodiments of the present disclosure are presented. In some embodiments, the hem bar engages or is coupled to (used interchangeably herein without the intent to limit) a covering such as, for example, a rollable flexible fabric or screen (e.g., an outdoor insect screen, a solar screen, a hurricane screen, a privacy and security screen, etc.). The hem bar of the present disclosure may, however, be embodied in many different forms and should not be construed as being limited to the embodiments set forth herein. Rather, these embodiments are provided so that this disclosure will convey certain example aspects of the hem bar to those skilled in the art. In the drawings, like numbers refer to like elements throughout unless otherwise noted.

As will be described in greater detail below, in one embodiment, a hem bar 200 in accordance with the present disclosure is used in connection with a covering 100, for example, a roller-type outdoor covering, as illustrated in FIG. 1. In use, the covering 100 is movable between an extended position and a retracted position in relation to an architectural structure, which, without limitation, may be an opening such as a window, doorway, archway, a portion of a wall, or the like. It will be appreciated that references to an architectural opening/structure are made for convenience, and without intent to limit the present disclosure to a particular structure.

In use, the hem bar 200 is operatively coupled to a lower end of the covering 100 so that the hem bar 200 is movably associated with the covering 100. In one embodiment, the hem bar 200 includes a weather strip (e.g., a brush, a gasket, or the like) for contacting or resting on a contacting surface S (e.g., a floor, a ledge, a sill, or the like) when the covering 100 is in a fully extended position. As will be described in greater detail, in one embodiment, the weather strip is vertically, movably positioned within a weather-strip-receiving-channel formed in the hem bar 200. In this manner, the position of the weather strip relative to the hem bar 200 may be movably adjusted so that the weather strip is better able to contact the contacting surface S such as, for example, an uneven or non-level contacting surface. Additionally, in one embodiment, the weather strip may be downwardly biased relative to the hem bar 200 to facilitate better sealing between the bottom edge of the weather strip and the contacting surface S, and to assist with ensuring that the body of the hem bar 200 never rests on the contacting surface S.

Additionally, and/or alternatively, as will be described in greater detail, in one non-limiting example of an embodiment, the weather strip may be in the form of a two-part weather strip including a solid upper part and a hollow, accordion-like lower part. Additionally, and/or alternatively, the weather strip may be arranged and configured to better adapt to the contour, slope, etc. of the contacting surface S and thereafter maintain its contoured shape even when no longer in contact with the contacting surface S. For example, in one embodiment, the weather strip may be manufactured from an engineered plastic such as, for example, a soft plastic like a soft polyvinyl chloride (pvc), a urethane, etc. Alternatively, in another example, the weather strip may be manufactured from polypropylene, styrene-ethylene-butylene rubber, styrene-ethylene-butylene rubber with calcium carbonate, or a combination thereof.

Additionally, and/or alternatively, as will be described in greater detail below, in one embodiment, the hem bar 200 includes a plurality of weight-receiving chambers. That is, the hem bar 200 includes a plurality of chambers for receiving, for example, a weighted rod, a weighted bar, or the like. In this manner, the weighted hem bar 200 provides additional, increased weight to the lower end of the covering 100 to assist in maintaining the covering 100 in a taut condition (e.g., assists with maintaining constant tension on the covering 100) in the extended position. By maintaining the covering 100 in a taut condition, a desired smooth (i.e., wrinkle-free) appearance of the covering 100 can be maintained. Additionally, the weighted hem bar 200 facilitates a better seal between the bottom edge of the hem bar 200 and the contacting surface S.

Additionally, and/or alternatively, as will be described in greater detail below, in one embodiment, the hem bar 200 has a symmetrical design. That is, in one embodiment, the hem bar 200 may include a first or cover-receiving channel for receiving a lower end of the covering 100. In addition, the hem bar 200 may include a second or weather-strip-receiving-channel for receiving the weather strip. In addition, the hem bar 200 may include a plurality of weight-receiving chambers. The plurality of weight-receiving chambers may be evenly distributed within the body of the hem bar to eliminate or minimize any tilting or rocking motion. The first and second channels may be centrally located and aligned with a central longitudinal axis of the hem bar 200 and covering 100. That is, the first and second channels may be centrally located within the hem bar 200 so that the central longitudinal axes of the first and second channels are coaxially aligned with the longitudinal axis of the body of the hem bar 200, which may be coaxially aligned with the longitudinal axis of the covering 100. In addition, the weight-receiving chambers may be operatively positioned about the hem bar 200 so that the hem bar 200 is symmetrical about the central longitudinal axis of the hem bar 200. In this manner, the hem bar 200 is better able to eliminate any tilting or rocking motion.

In use, providing a symmetrically weighted hem bar 200 incorporating a biased weather strip enables the hem bar 200 to maintain constant tension on the covering 100 regardless of how level the contacting surface S is. That is, the levelness of the contacting surface affects how the hem bar 200 rests in the extended position, which affects the appearance of the covering 100. For example, if one side of the hem bar 200 contacts the contacting surface S before the other side of the hem bar 200, the covering 100 could become uneven, wavy, or the like. That is, an uneven hem bar 200 could cause at least a portion (e.g., one side) of the covering 100 to lose tension created by the weight of the hem bar 200. In addition, allowing the hem bar 200 to rest unevenly on the contacting surface S adversely affects how the system operates. For example, an uneven contacting surface S could cause the covering 100 to loosen. Over time, if the covering 100 becomes too loose, the system will not roll up properly, potentially causing the covering 100 to jam during retraction and/or extension operations. As will be further described herein, by providing a hem bar 200 in accordance with the present disclosure, the hem bar 200 is better able to adjust to uneven contacting surfaces S without the covering 100 losing the tension created by the weight of the hem bar 200. For example, in one embodiment, the weather strip may be biased to provide a better contact (e.g., seal) along the full length of the weather strip against the contacting surface S (e.g., weather strip is better able to match the slope of the uneven contacting surface S) while ensuring that the body of the hem bar 200 never rests on the contacting surface S thus ensuring that constant tension is maintained on the covering 100. Additionally, the symmetrical design of the hem bar 200 minimizes tilting or pivoting.

Figure 2:
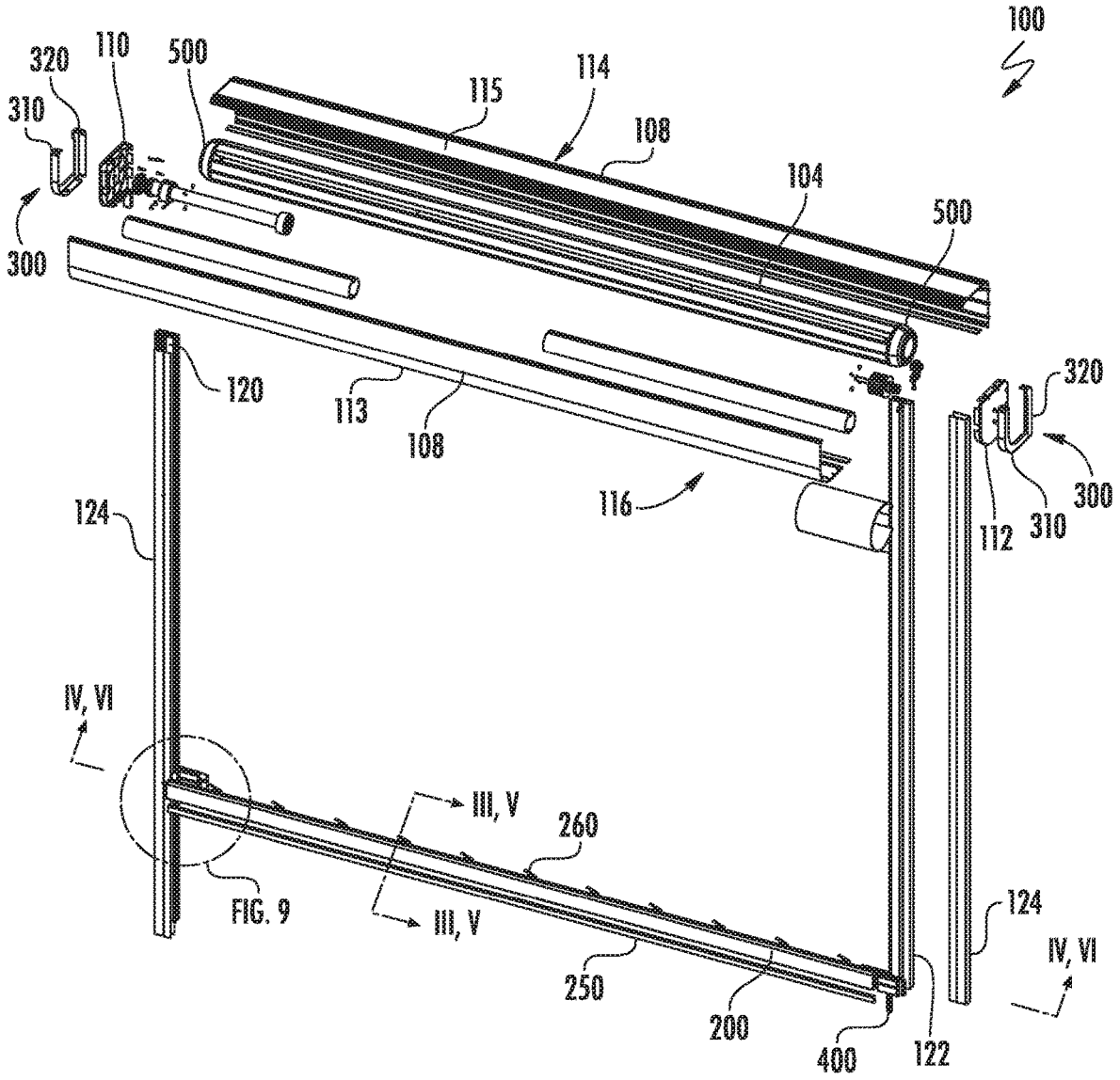
FIG. 2 is an exploded, perspective view illustrating various example components of the architectural-structure covering shown in FIG. 1.

FIG. 2 shows an example of an embodiment of an architectural-structure covering 100 that incorporates a hem bar assembly 200 according to the present disclosure. The architectural-structure covering 100 may include a headrail 108, which in the illustrated embodiment is a housing having opposed end caps 110, 112 joined by front 113, back 114, and top sides 115 to form an enclosure with an open bottom side 116 so that a covering 106 may pass therethrough. The headrail 108 may also include mounts for coupling the headrail 108 to a structure above, or at the top of, an architectural opening, such as a wall, via mechanical fasteners such as screws, bolts, or the like. A rotatable member 104 may be rotatably coupled between the end caps 110, 112. Although a particular example of a headrail 108 is shown in FIG. 2, many different types and styles of headrails exist and could be employed in place of the example headrail of FIG. 2.

Figure 9:
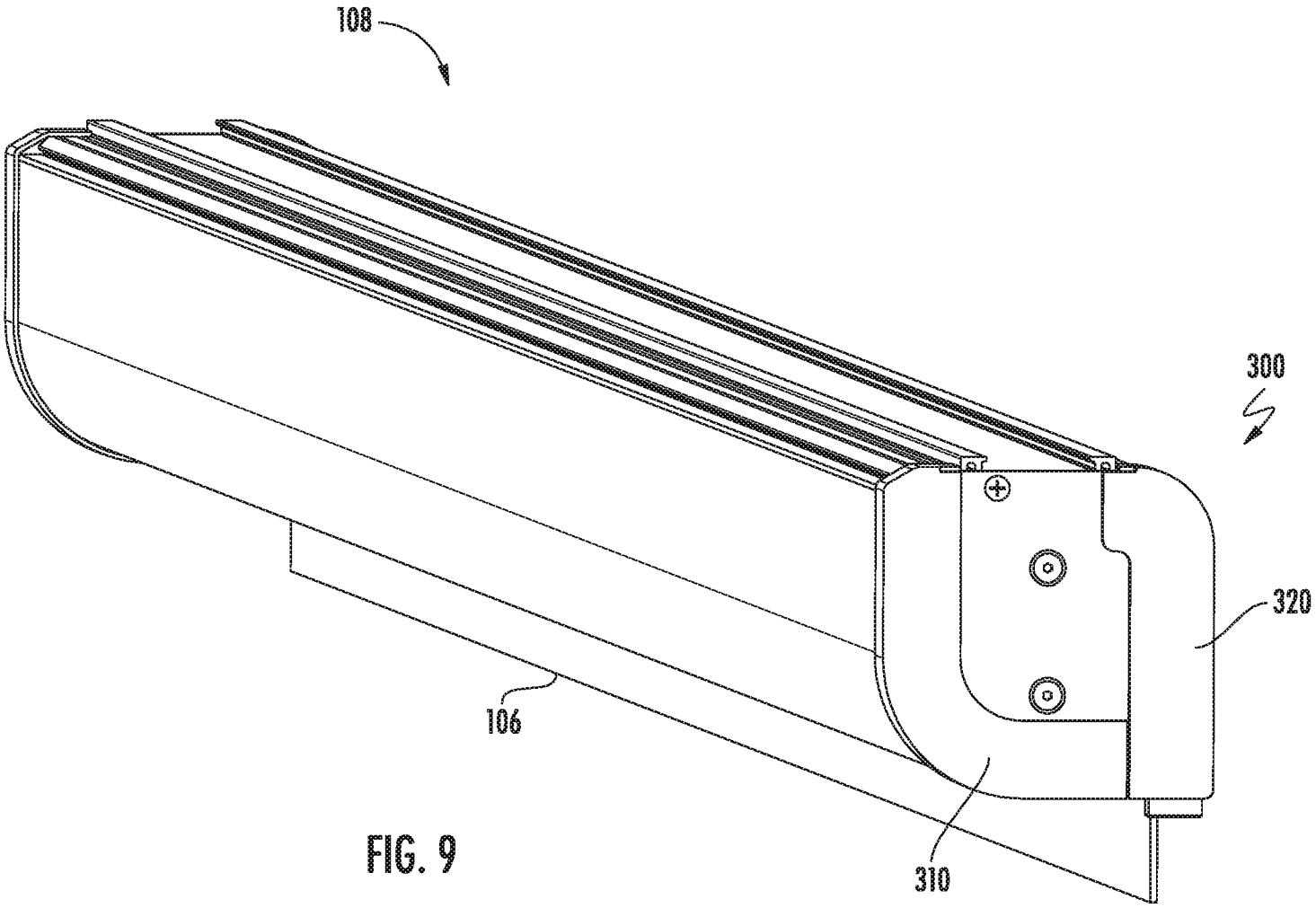
FIG. 9 is a side, perspective view of an example of an embodiment of end cap covers in accordance with another aspect of the present disclosure.

The architectural-structure covering 100 may also include a covering portion 106 (shown in FIG. 9, omitted from FIG. 2 for clarity). In use, the covering 106 may be a sheet of material having an upper edge coupled to the rotatable member 104 and a lower, free edge coupled to the hem bar 200. In use, the covering 106 may be in the form of a flexible fabric, a rollable screen (e.g., an outdoor insect screen, a solar screen, a hurricane screen, a privacy and security screen, etc.), or the like coupled to the rotatable member 104. However, it will be appreciated that other covering types and mounting arrangements are within the scope of the present disclosure. The covering 106 is movable between a retracted position and an extended position (illustratively, the position shown in FIG. 1). In one embodiment, when in the retracted position, the covering 106 is wound about the rotatable member 104, although other manners of retracting coverings are envisioned. Although not shown, a drive mechanism can be provided to move the covering 106 between the extended and retracted positions. The drive mechanism can take any appropriate form (e.g., a motorized system, a clutch, a gear, a motor, a drive train, and/or a gear train, etc.) and can include any type of controls (e.g., continuous loop, raise/lower cord(s), chains, ropes, a motor, etc.). In one embodiment, the architectural-structure covering 106 includes first and second side tracks 120, 122 for receiving and guiding lateral side edges of the covering 106 as the covering 106 moves between the extended and retracted positions.

Referring to FIG. 2, for the sake of convenience and clarity, terms such as "front," "rear," "top," "bottom," "lower", "up," "down," "vertical," "horizontal", "inner," and "outer" may be used herein to describe the relative placement and orientation of various components and portions of the covering 100, each with respect to the geometry and orientation of the covering 100 as they appear in FIG. 2. Said terminology is intended to be non-limiting and is used herein merely to describe relationship between various components as illustrated in FIG. 2.

Figure 3:
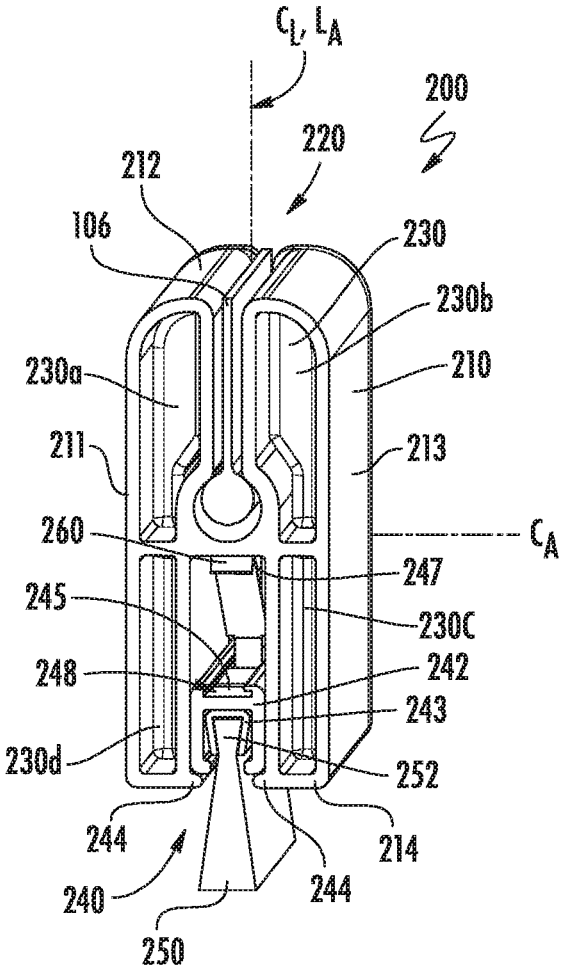
FIG. 3 is a cross-sectional, perspective view taken along line III-III in FIG. 2 of an example of an embodiment of a hem bar for use with the architectural-structure covering shown in FIG. 1, the weather strip shown in an extended position.
Figure 4:
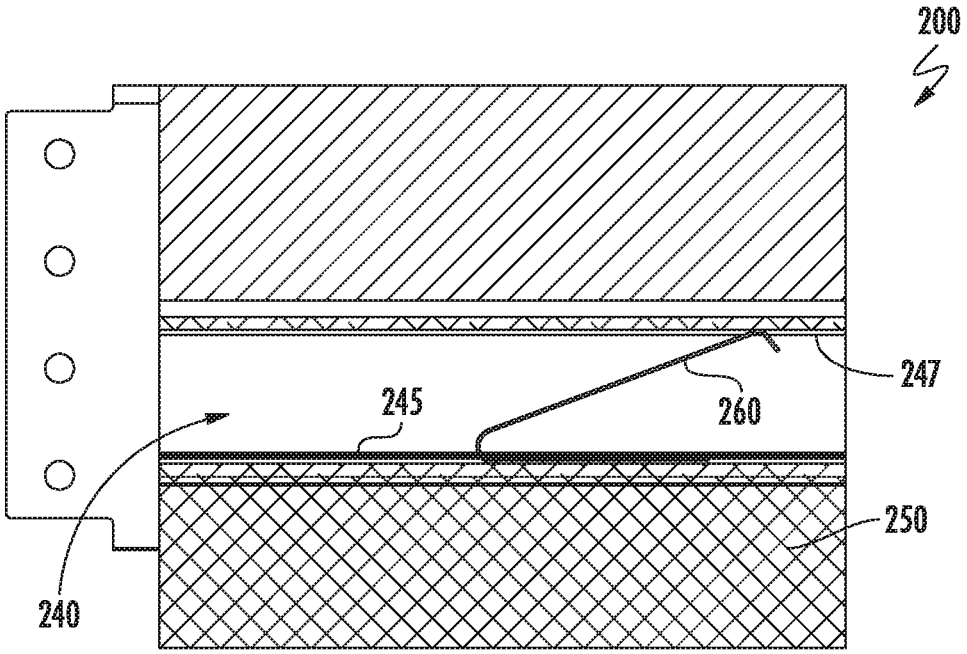
FIG. 4 is a cross-sectional view of the hem bar taken along line IV-IV in FIG. 2, the weather strip illustrated in a biased, extended position.
Figure 5:
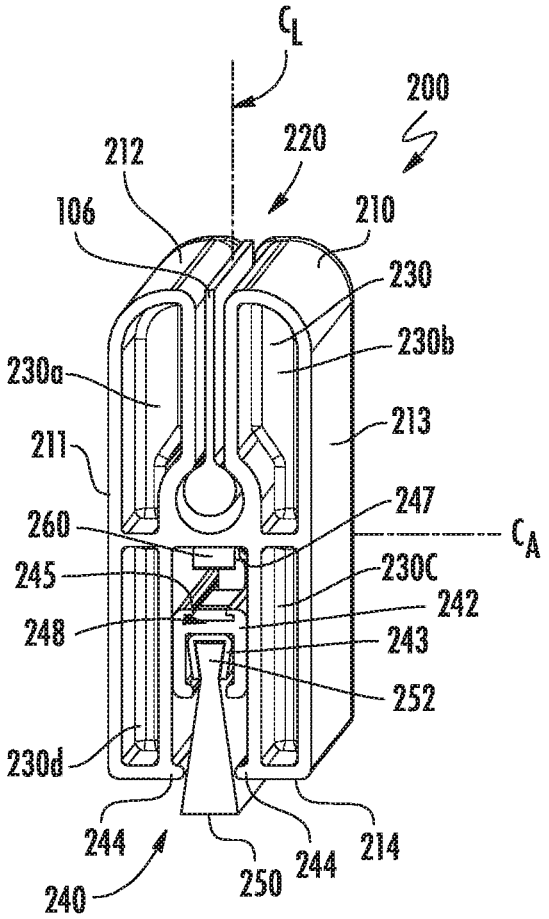
FIG. 5 is a cross-sectional, perspective view taken along line V-V in FIG. 2 of the hem bar shown in FIG. 3, the weather strip shown in a retracted position.
Figure 6:
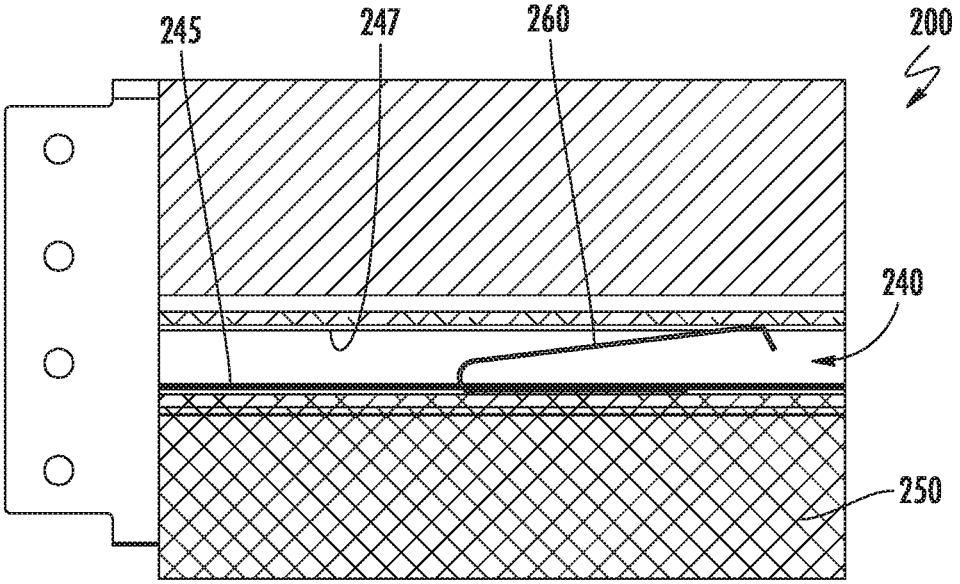
FIG. 6 is a cross-sectional view of the hem bar taken along line VI-VI in FIG. 2, the weather strip illustrated in a retracted position.

Referring to FIGS. 3 and 5, cross-sectional, perspective views of an example of an embodiment of a hem bar 200 according to the present disclosure is illustrated. As illustrated, the hem bar 200 includes a body member 210 having a top end 212 and a bottom end 214. In use, the hem bar 200 is coupled to the covering 106, for example, a lower end of the covering 106. As previously mentioned, in one embodiment, the hem bar 200 serves to add weight to the covering 106 so that the covering 106 is kept in a taut condition (e.g., hem bar 200 maintains constant tension on the covering 106) in the extended position. By weighting the lower end of the covering 106, the hem bar 200 maintains the covering 106 in a taut condition to eliminate or minimize the formation of wrinkles or the like in the covering 106 to facilitate an improved aesthetic and smoother operation of the architectural-structure covering 100 as the covering 106 is wound and unwound. In addition, by incorporating a weighted hem bar 200, an improved seal may be created between a bottom edge of the hem bar 200 (e.g., weather strip) and the contacting surface S (FIG. 1) such as, for example, a floor.

The hem bar 200 may be coupled to the covering 106 by any suitable mechanism now known or hereafter developed. In one embodiment, as illustrated, the hem bar 200 includes a first or cover-receiving channel 220 open through the top end 212 of the body 210 for receiving a lower end of the covering 106. The covering 106 can be secured within the cover-receiving channel 220 by any suitable mechanism now known or hereafter developed such as, for example, a Kedar, a rod, or the like. As illustrated, and as will be described in greater detail, in one embodiment, the cover-receiving channel 220 may be centrally located so that a longitudinal axis $L_A$ of the covering 106 is coaxially aligned with a central longitudinal axis $C_L$ of the hem bar 200.

The hem bar 200 may also include one or more weight-receiving chambers 230 for receiving an elongated weight, for example, a weighted rod, a weighted bar, or the like. Incorporating one or more weight-receiving chambers 230 into the hem bar 200 assists with maintaining the covering 106 in a taut condition when in the extended position. In one embodiment, the weight-receiving chambers 230 are evenly sized and distributed about the central longitudinal axis $C_L$ of the hem bar 200 so that the hem bar 200 is symmetrical (e.g., either side of the hem bar 200 about the central longitudinal axis $C_L$ is a mirror image of the other side. In addition, the hem bar 200 is a mirror image on either side of a central lateral axis $C_A$ (e.g., a horizontal axis passing through a midpoint of the hem bar 200)). By incorporating a symmetrical hem bar, the hem bar 200 is better able to maintain the covering 106 in a taut condition while eliminating or minimizing any moment arms, thus eliminating or minimizing any tendency for the hem bar 200 to rock or pivot.

As illustrated, in one embodiment, the hem bar 200 may include four weight-receiving chambers 230*a*, 230*b*, 230*c*, 230*d* distributed about the body 210 of the hem bar 200, although more or fewer chambers may be included. As previously mentioned, the weight-receiving chambers 230*a*, 230*b*, 230*c*, 230*d* may be symmetrically distributed about the central longitudinal axis $C_L$ and the central lateral axis $C_A$ of the hem bar 200. For example, as illustrated, the first weight-receiving chamber 230*a* may be located in the upper front quadrant (e.g., between a front surface 211 of the hem bar 200 and the central longitudinal axis $C_L$; above the central lateral axis $C_A$), the second weight-receiving chamber 230*b* may be located in the upper rear quadrant (e.g., between a rear surface 213 of the hem bar 200 and the central longitudinal axis $C_L$; above the central lateral axis $C_A$), the third weight-receiving chamber 230*c* may be located in the lower rear quadrant (e.g., between the rear surface 213 of the hem bar 200 and the central longitudinal axis $C_L$; below the central lateral axis $C_A$), and the fourth weight-receiving chamber 230*d* may be located in the lower front quadrant (e.g., between the front surface 211 of the hem bar 200 and the central longitudinal axis $C_L$; below the central lateral axis $C_A$). As illustrated, the first and second weight-receiving chambers 230*a*, 230*b* may be equally sized so that they can receive an equally sized elongated weight. Similarly, the third and fourth weight-receiving chambers 230*c*, 230*d* may be equally sized so that they can receive an equally sized elongated weight. It will further be appreciated that the weight-receiving chambers can be provided in any of a variety of different size and shape combinations (other than the specific embodiment illustrated) to achieve a desired evenly weighted configuration for the resulting hem bar 200.

Figure 8:
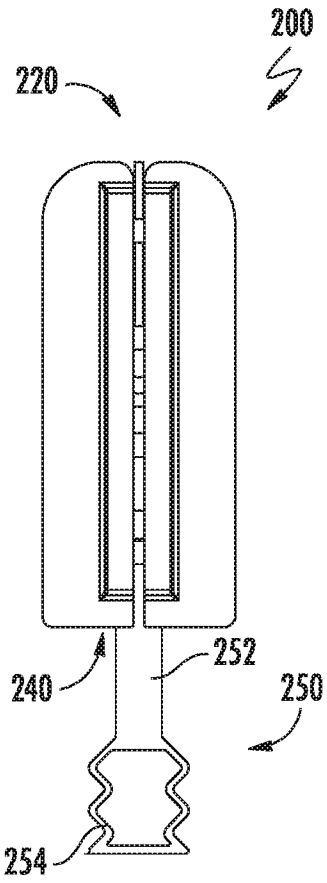
FIG. 8 is a side of the hem bar shown in FIG. 7, the weather strip shown in an extended position.
Figure 7:
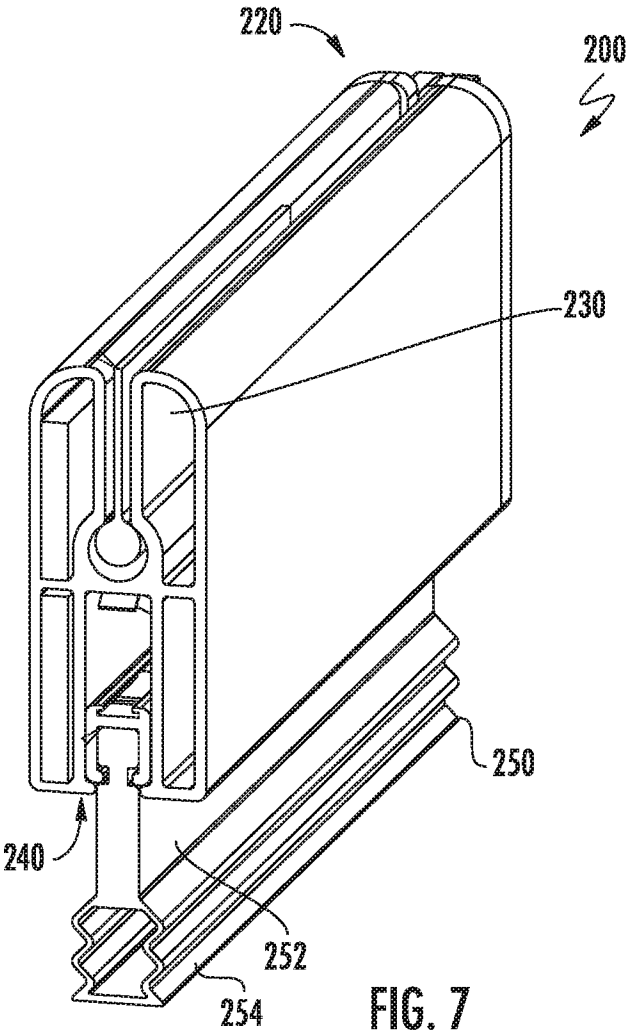
FIG. 7 is a cross-sectional, perspective view of an alternate example of an embodiment of a hem bar for use with the architectural-structure covering shown in FIG. 1, the weather strip shown in an extended position.

The hem bar 200 may also include a second or weather-strip-receiving-channel 240 opening through a bottom end 214 of the hem bar 200. In use, the second channel 240 is adapted and configured to receive a weather strip 250 such as, for example, a brush or gasket, for contacting a contacting surface such as a floor, a ledge, a sill, an outdoor surface, or the like. Referring to FIGS. 7 and 8, in one example of an embodiment, the weather strip 250 may be in the form of a two-part weather strip 250 including an upper part 252 and a lower part 254. In use, the upper part 252 is arranged and configured to couple to the hem bar 200, as will be described in greater detail below. The lower part 254 is arranged and configured to contact and conform to the contours of the contacting surface (e.g., floor). As shown, in one embodiment, the upper part 252 may be solid while the lower part 254 may be hollow and include an accordion-like shape.

The weather strip 250 may be formed from any suitable material now known or hereafter developed. In one embodiment, the weather strip 250 is arranged and configured to adapt to the contour, slope, etc. of the contacting surface S. For example, in one embodiment, the weather strip 250 is adapted and configured to be concave and/or convex in shape relative to the contacting surface S to better conform, seal, etc. against the contacting surface S. In addition, in one embodiment, the weather strip 250 is arranged and configured to maintain its shape (e.g., in use, after contacting the contacting surface S, with the covering 106 in a retracted position or a partially retracted position (e.g., not in contact with the contacting surface S), the weather strip 250 is adapted and configured to maintain the contoured shape corresponding to the shape of the contacting surface S).

For example, in one embodiment, the weather strip 250 is arranged and configured to conform to the contour of the contacting surface S and, thereafter, to maintain its contoured shape and position relative to the body 210 of the hem bar 200. That is, once the weather strip 250 conforms to the contoured surface of the contacting surface S, the weather strip 250 is adapted and configured to maintain its contoured shape and position relative to the body 210 of the hem bar 200. Thus arranged, it has been found that the weather strip 250 is better able to conform to the contoured surface of the contacting surface S. In addition, and/or alternatively, it has been found that the hem bar 200 is better adapted to maintain tension on the covering 106 by not allowing weight such as, for example, the weight of the hem bar 200 (e.g., weight of the body portion 210 of the hem bar 200), to transfer from the hem bar 200 to the contacting surface S beneath the hem bar 200. That is, by maintaining its shape and position, the weather strip 250 helps ensure that the weather strip 250 remains in contact with the contacting surface S when in an extended position, and that the weight of the hem bar 200 is not transferred to the contacting surface S, thus the weight of the hem bar 200 helps maintain the covering 106 in tension (e.g., the body 210 of the hem bar 200 does not contact the contacting surface S, thus maintaining tension on the covering 106 to maintain the covering 106 in a taut condition even when the covering 106 is in a fully extended position). In one embodiment, the weather strip 250 may maintain its contoured shape via memory of the material used to form the weather strip 250. In addition, and/or alternatively, the weather strip 250 may maintain its position relative to the body 210 of the hem bar 200 via friction between the weather strip holder 242 and the inner surfaces of the second or weather-strip-receiving-channel 240.

In one embodiment, the weather strip may be manufactured from an engineered plastic arranged and configured to contour to the surface of the contacting surface while also arranged and configured to maintain its contoured shape even when not contacting the contacting surface. For example, in one embodiment, the weather strip may be manufactured from a soft plastic such as, for example, a soft polyvinyl chloride (pvc), urethane, thermoplastic, an elastomer, a thermoplastic elastomer, or the like. In another embodiment, the weather strip may be manufactured from polypropylene, styrene-ethylene-butylene rubber, styrene-ethylene-butylene rubber with calcium carbonate, or a combination thereof.

As shown, in one embodiment, the weather strip 250 may be extruded. That is, the upper part 252 may be integrally formed with the lower part 254. Alternatively, however, the lower and upper parts 252, 254 may be separately formed and coupled to each other by any suitable means including, for example, an adhesive.

Referring back to FIGS. 3 and 5, the weather strip 250 may be coupled to the hem bar 200 by any suitable mechanism now known or hereafter developed. As illustrated, and as will be described in greater detail, the second channel 240 may be centrally located so that a longitudinal axis of the second channel 240 is coaxially aligned with the central longitudinal axis $C_L$ of the hem bar 200. In this manner, as illustrated, the second channel 240 is positioned directly below the cover-receiving channel 220. As such, as previously mentioned, the hem bar 200 may be symmetrical about the central longitudinal axis $C_L$ thereof.

In one embodiment, as illustrated, the hem bar 200 may include a weather strip holder 242 for coupling to a top end 252 of the weather strip 250. The weather strip holder 242 may be coupled to the weather strip 250 by any suitable mechanism now known or hereafter developed including, for example, an adhesive, fasteners, etc. As illustrated, the weather strip holder 242 may include a clip 243 for coupling the weather strip 250 to the weather strip holder 242.

In use, the weather strip holder 242 is moveably positionable within the second channel 240. That is, in use, the weather strip holder 242, and hence the weather strip 250 coupled thereto, are vertically movable relative to the hem bar 200. In this manner, the weather strip 250 is better able to make sealing contact with the contacting surface (e.g., floor). As illustrated, the second channel 240 may include a pair of inwardly-extending projections 244 at the bottom end 214 to prevent the weather strip holder 242, and the weather strip 250, from falling out of the second channel 240 formed in the body 210. In this manner, the weather strip holder 242, and hence the weather strip 250, is able to move freely up and down within the second channel 240 as needed to contact, for example, the contacting surface S (e.g., an uneven floor). Meanwhile, the weather strip holder 242 and the weather strip 250 are prevented from falling out of the second channel 240 of the body 210 by the inwardly-extending projections 243 (e.g., projections 243 form a bottom opening that is narrower than the weather strip holder 242).

In one embodiment, the hem bar 200 also includes a biasing member 260 for biasing the weather strip holder 242, and hence the weather strip 250, in a downwardly-extending position (i.e., toward the contacting surface S). In this manner, the hem bar 200 is better able to bias the weather strip 250 into sealing contact with the contacting surface S when in the extended position by providing a movable, biased seal that is better able to conform with a non-level contacting surface. By downwardly biasing the weather strip 250, the weather strip 250 is able to contact the contacting surface while preventing the body 210 of the hem bar 200 from contacting the contacting surface (e.g., by downwardly biasing the weather strip 250, the weather strip 250 is able to form a sealing contact with the contacting surface S while ensuring that the body 210 of the hem bar 200 does not rest on the contacting surface S). As a result, the body 210 never contacts the contacting surface S, thus ensuring that the weight of the hem bar 200 is continuously applied to the covering 106, thereby ensuring that the covering 106 is constantly tensioned and remains in a taut condition, ensuring a neat, wrinkle-free appearance of the covering 106.

The biasing member 260 may be any biasing member now known or hereafter developed such as, for example a spring member (e.g., coiled springs or the like). As illustrated, in one embodiment, the biasing member may be a plurality of leaf springs (e.g., U-shaped spring) or harmonic springs (e.g., V-shaped spring) positioned between a top surface 245 of the weather strip holder 242 and an inner surface 247 of the second channel 240. Generally speaking, incorporation of harmonic springs provide increased travel (e.g., increased vertical movement) while incorporation of leaf springs provide increased flexibility. In the non-limiting example illustrated embodiment, the end of the weather strip holder 242 may include a rail 248 for receiving the plurality of leaf springs or harmonic springs 260.

In use, referring to FIGS. 3-6, in the at-rest position (i.e., before the hem bar 200 contacts the contacting surface S), the weather strip holder 242, and the weather strip 250 coupled thereto, may assume a downwardly-extended position (the configuration illustrated in FIGS. 3 and 4) due to the biasing force of the biasing member 260. When the covering 106 is in the extended position and in contact with the contacting surface S however (the configuration illustrated in FIGS. 5 and 6), the weather strip 250 and weather strip holder 242 may move upwards relative to the body 210 against the biasing force of the biasing member 260. By providing a biased weather strip 250, an improved seal is achieved between the bottom edge of the weather strip 250 and the contacting surface S. Thus, in some examples, the hem bar 200 may provide a self-adjusting bottom surface for contacting a non-level floor. As a result, in use, when the hem bar 200 contacts a non-level contacting surface S, the body 210 of the hem bar 200 may remain level while the weather strip 250 may adjust to better conform to the non-level contacting surface S.

Figure 10:
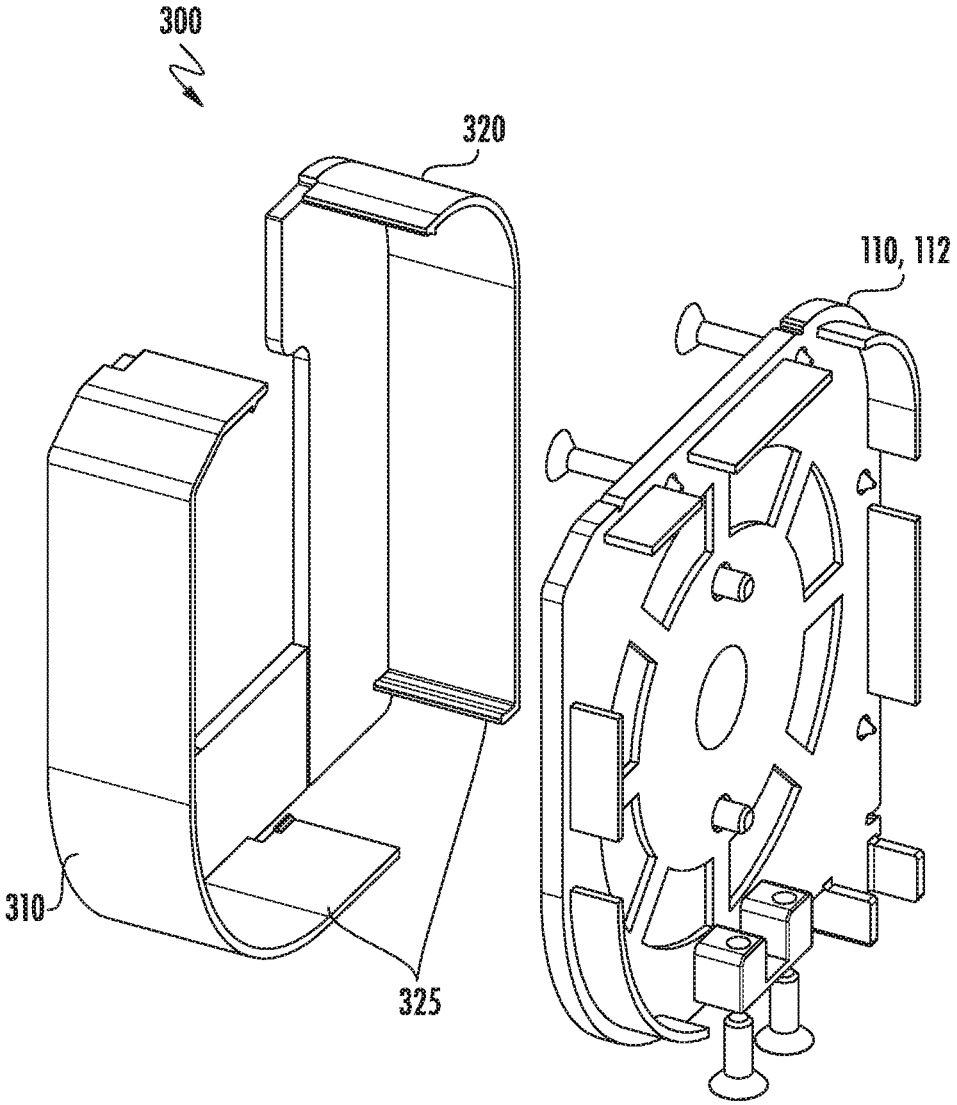
FIG. 10 is an exploded perspective view of the end cap covers shown in FIG. 9.

Referring to FIGS. 2, 9, and 10, in accordance with another aspect of the present disclosure, the headrail 108 may also incorporate one or more end cap covers 300 coupled to the headrail assembly 108, such as, for example, the end caps 110, 112. In use, the end cap covers 300 are coupled to the end caps 110, 112 to extend the headrail 108 to prevent, cover, or occupy any gaps between the end caps 110, 112 and a side surface of the structural opening. Such gaps can occur, for example, when the structural opening is non-square. That is, for example, in use, the dimension of the structural opening may not be the same at the top and bottom of the opening. As such, it would be desirable to dimension the covering 100 to accommodate the smaller of the width dimensions at the top and bottom of the structural opening. As a result, gaps may be formed between the end caps 110, 112 of the headrail 108 and the structural opening (e.g., gaps can occur when the dimensions of the headrail 108 does not conform to the exact dimension of the structural opening). When these gaps are formed at the top end thereof, the end cap covers 300 may be used to extend the headrail 108 and to close the gaps formed between, for example, the ends of the headrail 108 and the structural opening.

In use, the end cap covers 300 substantially correspond with the shape of the headrail 108, and more specifically with the shape of the end caps 110, 112. In use, the end cap covers 300 may be coupled to the headrail 108 (e.g., end caps 110, 112) by any means now known or hereafter developed, including for example, a friction-fit connection. As illustrated, in one embodiment, the end cap covers 300 may include first and second components 310, 320, although it is envisioned that the end cap covers 300 may be manufactured from more or fewer components. Manufacturing the end cap covers 300 from first and second components 310, 320 facilitates easier installation. As illustrated, the first component 310 is attached to a front surface of the headrail 108. The second component 320 is attached to a rear surface of the headrail 108. As illustrated in FIG. 10, the first and second components 310, 320 may include inwardly projecting projections 325 for receiving the end caps 310, 320.

The end cap cover 300 may include a fixed thickness for coupling to the end caps 110, 112. Alternatively, the end cap cover 300 may be adapted and configured to be movably positioned with respect to the end caps 110, 112. In use, it is envisioned that a plurality of end cap covers 300 having varying thicknesses may be provided, for example, in a kit. In this manner, based on the size of the existing gap between the ends of the headrail 108 and the structural opening, an appropriately sized end cap cover 300 can be selected.

In one embodiment, it is envisioned that a plurality, or kit, of end cap covers 300 may be provided with varying thicknesses ranging from, for example, 1/16" to 1", although these dimensions are merely exemplary and other thicknesses may be used. By providing a plurality of end cap covers 300 with varying thicknesses, an installer can select the best-fitting end cap cover 300 for their particular application. In this manner, the system can accommodate measurement discrepancies in the width of the headrail 108 relative to the structural opening.

Figure 11:
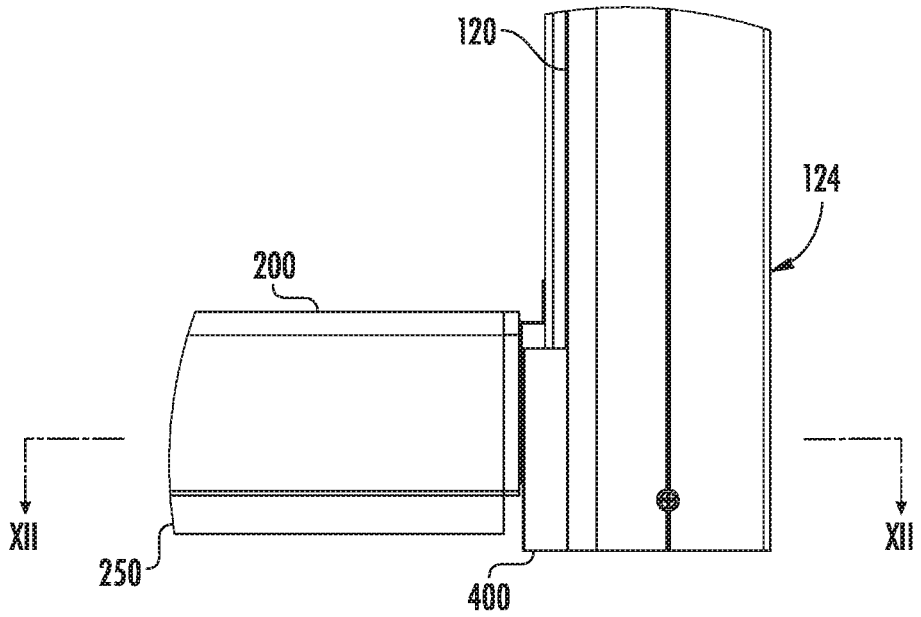
FIG. 11 is a detailed view of an example of an embodiment of a filler cap in accordance with another aspect of the present disclosure.
Figure 12:
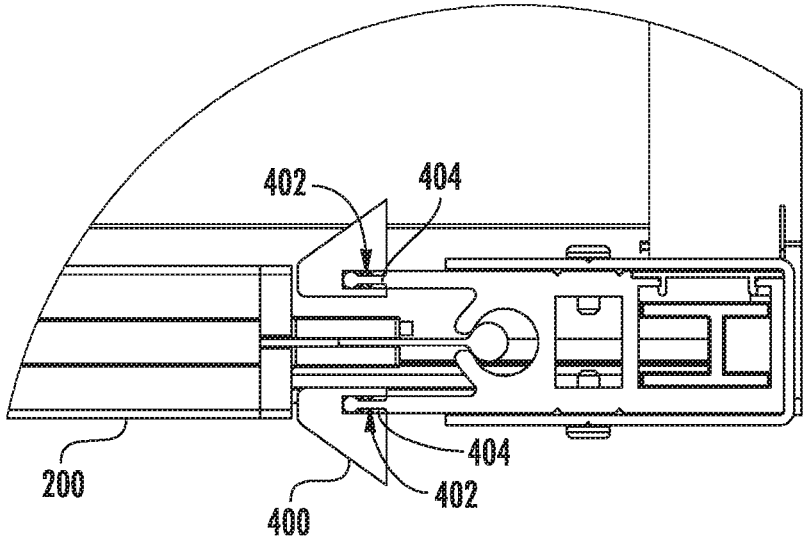
FIG. 12 is a cross-sectional view of the filler cap coupled to the side tracks of the architectural-structure covering shown in FIG. 2, the cross-sectional view taken along line XII-XII illustrated in FIG. 11.

In accordance with another aspect of the present disclosure, the hem bar such as, for example, hem bar 200 may travel (e.g., move between extended and retracted positions along with the covering 106) in first and second side tracks 120, 122 positioned on either end of the covering 106 and the hem bar (e.g., hem bar 200). In some implementations, the side tracks 120, 122 may include a guide cover 124. In use, however, the weather strip (e.g., weather strip 250) may contact the guide cover 124. As a result, the weather strip 250 is often trimmed to prevent the strip 250 from contacting the guide cover 124. This results in a gap being created between the ends of the weather strip 250 and each track 120, 122, potentially allowing mosquitoes or insects to enter. Referring to FIGS. 2, 11, and 12, an adjustable filler cap 400 may be provided. In use, the filler cap 400 may be coupled to the tracks 120, 122 to fill the gap created between the ends of the weather strip 250 and the tracks 120, 122. The filler cap 400 may be coupled to the tracks 120, 122 adjacent to the contacting surface S (e.g., floor). In use, the filler cap 400 extends from the contacting surface S to the bottom edge 214 of the hem bar 200 (e.g., the filler cap 400 extends approximately the height of the weather strip 260; the filler cap 400 extends from the contacting surface S to the top of the weather strip 260) so that, in use, the filler cap 400 fills the gap created by trimming the weather strip 250.

The filler cap 400 may have any appropriate shape. As illustrated in FIG. 12, the filler cap 400 may have a trapezoidal shape, although other shapes are envisioned. The filler cap 400 may be coupled to the tracks 120, 122 by any means now known or hereafter developed, including for example, a snap-fit connection. As illustrated, in one embodiment, the filler cap 400 includes a pair of channels 402 for receiving projections 404 extending from the track 120, 122.

The filler cap 400 may include a fixed thickness for coupling to the tracks 120, 122. In use, it is envisioned that a plurality of filler caps 400 having varying thicknesses may be provided, for example, in a kit. In this manner, based on the size of the existing gap between the ends of the weather strip 250 and the tracks 120, 122, an appropriately sized filler cap 400 can be selected.

In one embodiment, it is envisioned that a plurality or kit of filler caps 400 may be provided with varying thicknesses ranging from, for example, 1/16" to 1/4", although these dimensions are merely exemplary and other thicknesses may be used. By providing a plurality of filler caps 400 with varying thicknesses, an installer can select the best-fitting filler cap 400 for their particular application.

Figure 13:
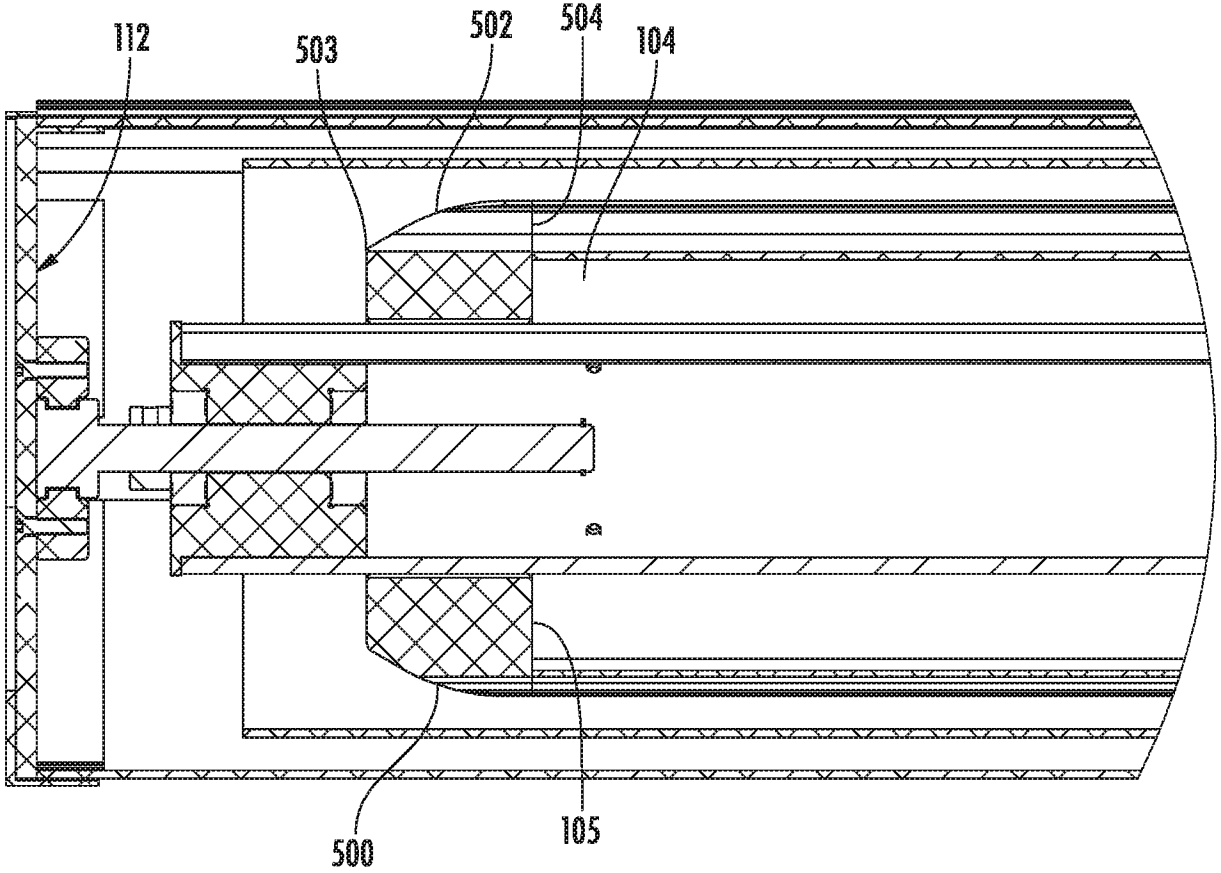
FIG. 13 is a detailed, cross-sectional view of an example of an embodiment of a tapered collar in accordance with another aspect of the present disclosure.

Architectural-structure coverings may also include a space between the side or lateral ends of the covering 106 and the side or lateral ends 105 (FIG. 13) of the rotatable member 104. This space may be created for any of a variety of reasons. For example, in some implementations, the architectural-structure covering 100 may include an exterior zipper system (e.g., a zipper coupled to the covering) or a Kedar shade panel (e.g., a binding that travels with the track) or the like (not shown). In either event, the zipper or Kedar is attached on either side of the covering 106. However, because the zipper or Kedar is thicker than the material of the covering 106 rolling on the rotatable member 104, the sides of the covering 106 including the zipper/Kedar will build up (e.g., have an increased thickness when wound about the rotatable member 104). As a result, to ensure that the covering 106 rolls up properly on the rotatable member 104, a space is needed to accommodate the zipper/Kedar (e.g., to accommodate the increased thickness). The space enables the covering 106 to fall and not build up. However, if the covering 106 falls from the ends 105 of the rotatable member 104, the covering 106 will wrinkle, shift, or the like (e.g., an undesirable line may be formed in the covering 106). That is, when the covering 106 hangs off a sharp or abrupt surface, the covering 106 compresses, forming a line or wrinkle in the covering 106.

In accordance with another aspect of the present disclosure, a tapered surface 502 may be provided at the ends 105 of the rotatable member 104 to prevent the covering 106 from wrinkling (e.g., to prevent the covering 106 from hanging off an abrupt surface). The tapered surface 502 may be created by any suitable mechanism. For example, in one embodiment, it is envisioned that the ends 105 of the rotatable member 104 may be tapered. Alternatively, referring to FIGS. 13-15, an example of an embodiment of a tapered collar 500 is illustrated. In use, the collar 500 may include a first end 503 and a second end 504. The first end 503 of the collar 500 includes the tapered surface 502 for the covering 106 to hang from. In use, the hanging of the covering 106 may be controlled by the curvature of the tapered surface 502 of the collar 500. In use, the tapered collar 500 facilitates proper positioning and hanging of the covering 106 by adjusting the space between the end of the covering 106 and the rotatable member 104. The tapered collar 500 closes the space (e.g., minimizes the distance between the end of the rotatable member and the end of the covering) and provides a smooth tapered surface 502 for the covering 106 to hang from, thus minimizing or eliminating the formation of a wrinkle or line.

Figure 14:
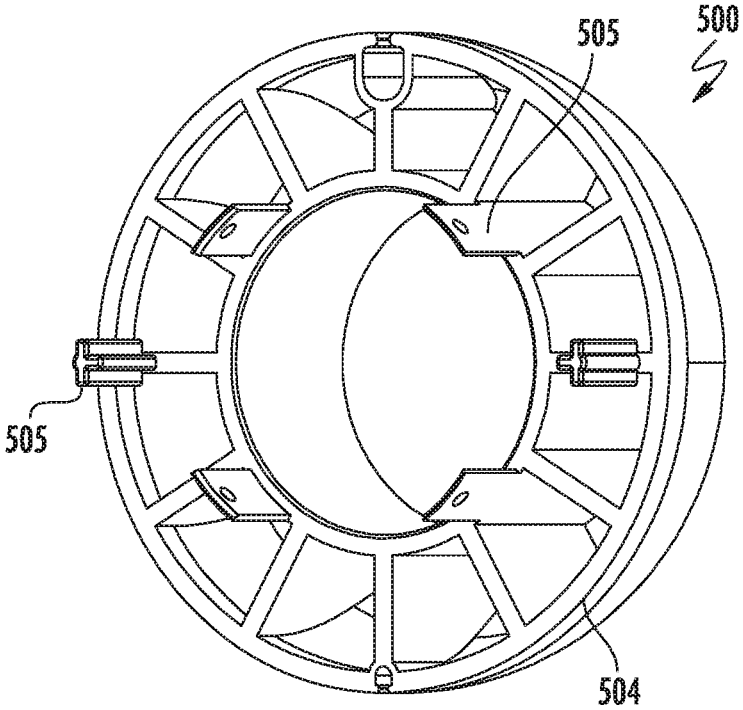
FIG. 14 is a rear perspective view of the collar shown in FIG. 13.
Figure 15:
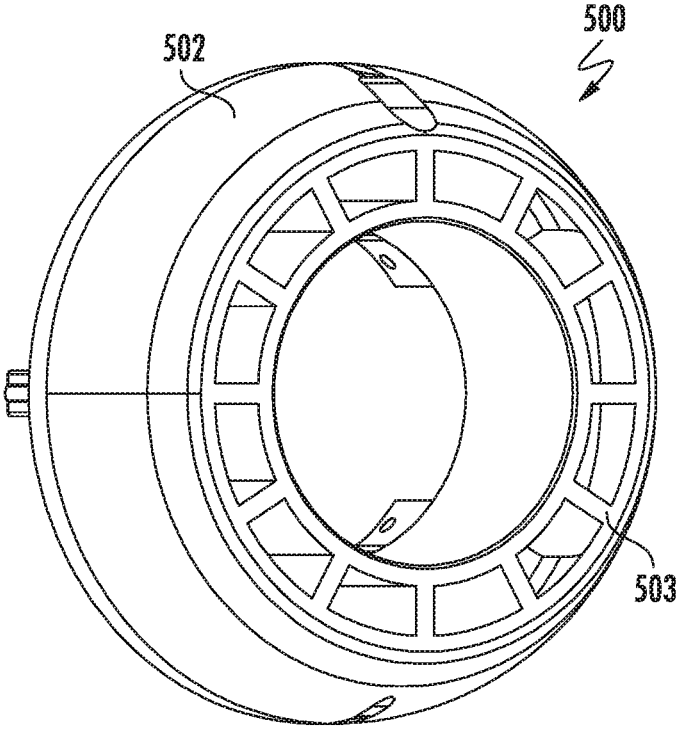
FIG. 15 is a front perspective view of the collar shown in FIG. 13.

The second end 504 of the collar 500 may be positioned adjacent to, and/or coupled to, the end 105 of the rotatable member 104. The second end 504 may be coupled by any suitable mechanism now known or hereafter developed including, for example, an adhesive, welding, fasteners, etc. As illustrated in FIG. 14, the second end 504 may include a plurality of projections 505 for engaging the end 105 of the rotatable member 104.

While the present disclosure makes reference to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The foregoing description has broad application. It should be appreciated that the concepts disclosed herein may apply to many types of coverings, in addition to the roller-type coverings described and depicted herein. Similarly, it should be appreciated that the concepts disclosed herein may apply to many types of operating systems, in addition to the operating system described and depicted herein. For example, the concepts may apply equally to any type of architectural-structure covering having a covering movable across an architectural structure. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

What is claimed:

1. An architectural-structure covering comprising:

a covering movable between an extended position and a retracted position;

a rotatable member coupled to an upper end of said covering so that rotation of said rotatable member moves said covering between said extended and retracted positions; and a hem bar coupled to a lower end of said covering, said hem bar including:

a weather strip for contacting a contacting surface when said covering is in a fully extended position, the weather strip extending from a top end to a bottom end, the bottom end to come into contact with the contacting surface;

wherein the weather strip tapers inward from the top end to a narrow width between the top end and the bottom end;

a body including:

a first channel for receiving a lower end of said covering;

a second channel for receiving said weather strip, the second channel having projections extending inwardly at a bottom of the second channel; and a plurality of weight-receiving chambers for receiving a plurality of weighted members, respectively;

a weather strip holder for coupling to the top end of said weather strip, said weather strip holder being vertically, movably positioned within said second channel formed in said body at a position above the projections, the projections preventing the weather strip holder from falling from the bottom of the second channel, said weather strip holder including a top surface with a rail that extends perpendicular to the second channel and the weather strip holder having an opening through which the top end of the weather strip extends, the opening being wider than the narrow width of the weather strip and narrower than a width of the top end of the weather strip; and a biasing member for biasing said weather strip holder relative to said body, said biasing member biasing said weather strip holder towards a downwardly extending position, the biasing member being one or more springs engaging with the rail such that downward force is applied to the top surface of the weather strip holder via the one or more springs;

wherein a portion of an outer surface of said weather strip holder contacts an inner surface of said second channel thereby creating a frictional force arranged and configured to resist said biasing member so that said weather strip holder and said weather strip maintain their position relative to said body in said retracted position; and wherein said first and second channels, and said plurality of weight-receiving chambers, are adapted and configured so that said hem bar is symmetric along a central longitudinal axis of said body.

2. The architectural-structure covering of claim 1, wherein said second channel opens through a bottom end of said body for receiving said weather strip, said second channel is positioned so that said weather strip is coaxially aligned with said covering.

3. The architectural-structure covering of claim 1, wherein said first channel opens through a top end of said body for receiving said lower end of said covering, said second channel opens through a bottom end of said body for receiving said weather strip, said first and second channels are coaxially aligned with the central longitudinal axis of said body.

4. The architectural-structure covering of claim 1, wherein said plurality of weight-receiving chambers are evenly distributed about the central longitudinal axis and a central lateral axis.

5. The architectural-structure covering of claim 4, wherein said plurality of weight-receiving chambers include first, second, third, and fourth weight-receiving chambers distributed about said body.

6. The architectural-structure covering of claim 5, wherein said first and fourth weight-receiving chambers are positioned on a first side of the central longitudinal axis and said second and third weight-receiving chambers are positioned on a second side of the central longitudinal axis.

7. The architectural-structure covering of claim 6, wherein said first and second weight-receiving chambers are positioned on a first side of the central lateral axis and said third and fourth weight-receiving chambers are positioned on a second side of the central lateral axis.

8. The architectural-structure covering of claim 5, wherein said central longitudinal and central lateral axes define first, second, third, and fourth quadrants in said body, said first weight-receiving chamber being positioned within said first quadrant, said second weight-receiving chamber being positioned within said second quadrant, said third weight-receiving chamber being positioned within said third quadrant, and said fourth weight-receiving chamber being positioned within said fourth quadrant.

9. The architectural-structure covering of claim 8, wherein said first and second weight-receiving chambers are equally sized for receiving first equally sized weighted members, respectively, and said third and fourth weight-receiving chambers are equally sized for receiving second equally sized weighted members, respectively.

10. The architectural-structure covering of claim 1, wherein said one or more springs are a plurality of leaf springs or a plurality of harmonic springs positioned between the top surface of said weather strip holder and a top surface of said second channel.

11. The architectural-structure covering of claim 1, wherein said weather strip includes a solid upper part and a hollow lower part.

12. The architectural-structure covering of claim 11, wherein said weather strip is manufactured from polypropylene, styrene-ethylene-butylene rubber, styrene-ethylene-butylene rubber with calcium carbonate, or a combination thereof.

13. The architectural-structure covering of claim 1, further comprising: a headrail for receiving at least a portion of said rotatable member, said headrail including first and second lateral ends; first and second end caps coupled to said first and second lateral ends, respectively, of said headrail; and one or more end cap covers coupled to at least one of said first and second end caps to extend said headrail to prevent any gaps between said end caps and a side surface of a structural opening.

14. The architectural-structure covering of claim 13, wherein each of said one or more end cap covers include first and second components, said first component being attached to a front surface of said at least one of said first and second end cap, said second component being attached to a rear surface of said at least one of said first and second end cap.

15. The architectural-structure covering of claim 1, further comprising:

first and second side tracks for receiving first and second lateral ends of said covering, respectively, and first and second lateral ends of said hem bar, respectively; and first and second filler caps for coupling to said first and second side tracks, respectively, said first and second filler caps being arranged and configured to fill any gaps created between first and second lateral ends of said weather strip and said first and second side tracks, respectively.

16. The architectural-structure covering of claim 15, wherein said first and second filler caps are coupled to said first and second side tracks, said first and second filler caps extending from the contacting surface to a bottom edge of said hem bar.

17. The architectural-structure covering of claim 1, wherein said rotatable member includes a tapered surface at an end thereof.

18. The architectural-structure covering of claim 1, further comprising a collar coupled to an end of said rotatable member, said collar including a first end and a second end, said first end including a tapered surface.

19. A hem bar for use with an architectural-structure covering, the architectural-structure covering including a covering movable between an extended position and a retracted position, the hem bar comprising:

a weather strip arranged and configured to contact a contacting surface when the covering is in a fully extended position, the weather strip extending from a top end to a bottom end, the bottom end to come into contact with the contacting surface, wherein the weather strip tapers inward from the top end to a narrow width between the top end and the bottom end;

a body including:

a first channel for receiving a lower end of the covering;

a second channel for receiving said weather strip, the second channel having projections extending inwardly at a bottom of the second channel; and a plurality of weight-receiving chambers for receiving a plurality of weighted members, respectively;

a weather strip holder arranged and configured to couple to the top end of said weather strip, said weather strip holder being vertically, movably positioned within said second channel formed in said body at a position above the projections, the projections preventing the weather strip holder from falling from the bottom of the second channel, the weather strip holder further having a top surface with a rail that extends perpendicular within the second channel, and the weather strip holder having an opening through which the top end of the weather strip extends, the opening being wider than the narrow width of the weather strip and narrower than a width of the top end of the weather strip; and a biasing member for biasing said weather strip holder relative to said body, said biasing member biasing said weather strip holder towards a downwardly extending position, the biasing member engaging directly with the rail to apply force;

wherein an outer surface of said weather strip holder contacts an inner surface of said second channel thereby creating a frictional force arranged and configured to resist said biasing member so that said weather strip holder and said weather strip maintain their position relative to said body in said retracted position;

wherein said first and second channels, and said plurality of weight-receiving chambers are adapted and configured so that said hem bar is symmetric along a central longitudinal axis of said body.

20. The hem bar of claim 19, wherein:

said first and second channels are coaxially aligned with the central longitudinal axis of said body; and said plurality of weight-receiving chambers are evenly distributed about the central longitudinal axis and a central lateral axis.

21. The hem bar of claim 19, wherein said biasing member comprises one of a plurality of leaf springs or a plurality of harmonic springs positioned between the top surface of said weather strip holder and a top surface of said second channel.

22. An architectural-structure covering comprising:

a covering movable between an extended position and a retracted position; a rotatable member coupled to an upper end of said covering so that rotation of said rotatable member moves said covering between said extended and retracted positions; and a hem bar coupled to a lower end of said covering, said hem bar including:

a weather strip for contacting a contacting surface when said covering is in a fully extended position, the weather strip extending from a top end to a bottom end, the bottom end to come into contact with the contacting surface;

wherein the weather strip tapers inward from the top end to a narrow width between the top end and the bottom end;

a body including:

a first channel for receiving a lower end of said covering; and a second channel for receiving said weather strip, said second channel having an opening with a first width, the second channel having projections extending inwardly at a bottom of the second channel;

a weather strip holder for coupling to the top end of said weather strip, said weather strip holder being vertically, movably positioned within said second channel formed in said body at a position above the projections, the projections preventing the weather strip holder from falling from the bottom of the second channel, said weather strip holder including an outer surface, said weather strip holder having a second width, the second width being greater than the first width to prevent the weather strip holder from exiting the opening of the second channel, the weather strip holder having an opening through which the top end of the weather strip extends, the opening being wider than the narrow width of the weather strip and narrower than a width of the top end of the weather strip; and a biasing member for biasing said weather strip holder relative to said body, said biasing member biasing said weather strip holder towards a downwardly extending position;

wherein said outer surface of said weather strip holder contacts an inner surface of said second channel thereby creating a frictional force arranged and configured to resist said biasing member so that said weather strip holder and said weather strip maintain their position relative to said body in said retracted position.

23. The architectural-structure covering of claim 22, wherein said body further comprising a plurality of weight-receiving chambers for receiving a plurality of weighted members, respectively; wherein said first and second channels, and said plurality of weight-receiving chambers are adapted and configured so that said hem bar is symmetric along a central longitudinal axis of said body.

24. The architectural-structure covering of claim 22, wherein said biasing member comprises one of a plurality of leaf springs or a plurality of harmonic springs positioned between a top surface of said weather strip holder and a top surface of said second channel.

* * * * *